US006322138B1

(12) United States Patent
Tang

(10) Patent No.: US 6,322,138 B1
(45) Date of Patent: Nov. 27, 2001

(54) COLLAPSIBLE PATIO CHAIR

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 0 days.

(21) Appl. No.: 09/561,339

(22) Filed: Apr. 28, 2000

(51) Int. Cl.[7] ..... A47C 4/28
(52) U.S. Cl. ..... 297/45; 297/16.2
(58) Field of Search ..... 297/45, 42, 44, 297/16.1, 16.2, 452.18, 59

(56) References Cited

U.S. PATENT DOCUMENTS 5,893,605 * 4/1999 Chang .
5,984,406 * 11/1999 Lee .
6,231,119 * 5/2001 Zheng .
6,237,993 * 5/2001 Zheng .

* cited by examiner

*Primary Examiner*—Milton Nelson, Jr.
(74) *Attorney, Agent, or Firm*—Charles I. Brodsky

(57) ABSTRACT

A patio chair incorporating a frame having left and right hand rests and pairs of crossed front, rear and side legs, and with connectors for stabilizing the chair when opened and for collapsing the chair to a compact package when closed, with front pad and rear pad connectors, and with rear connectors, being configured with generally perpendicular walls to apertures of which upper and lower ends of both rear legs and one side leg are pivotally connected, and with front connectors including a notch within which the upper end of both front crossed legs are arranged to glide in forming the support for the hand rests, and to which an upper end of the other side leg is also pivotally connected, for automatically folding the hand rests as the chair is being collapsed.

7 Claims, 7 Drawing Sheets

COLLAPSIBLE PATIO CHAIR

BACKGROUND OF THE INVENTION

1. Field of the Invention

This invention relates to foldable chairs, in general, and to a collapsible patio chair especially useful for casual seating, in particular.

2. Description of the Related Art

Folding or collapsible chairs in the nature of furniture have been described in such United States Patents as U.S. Pat. No. 3,635,520 (Roher et al) and U.S. Pat. No. 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, their acceptability depends in large part upon their strength and reliability of operation. In these two areas, the folding chair of the Lee Patent (U.S. Pat. No. 5,984,406) falls somewhat short.

SUMMARY OF THE INVENTION

As will become clear from the following description, the patio chair of the invention consists of a frame including pairs of front crossed legs and rear crossed legs, and two pairs of side crossed legs, with each pair of crossed legs being pivotally connected together where they cross; first and second front pad connectors pivotally connected to lower ends of one of the front crossed legs and one of the side crossed legs, respectively; first and second rear pad connectors pivotally connected to lower ends of one of the rear crossed legs and the other of the side crossed legs, respectively; first and second front connectors pivotally connected to upper ends of the one front crossed leg and the other of the side crossed legs, respectively; first and second rear connectors pivotally connected to upper ends of the rear crossed legs and the one side crossed leg, respectively; a pair of side supports passing through apertures in each of the first and second rear connectors having lower ends fixedly connected to the rear pad connectors; and a fabric liner connected to the first and second front connectors and to upper ends of the pair of side supports.

In accordance with the invention, to provide strength and reliability of operation beyond that characterizing the patented Lee design, the front connectors include a top surface having a notch therein open at one end and slightly larger than the diameter of the front crossed legs when composed as a tubular configuration, a first wall at an underside thereof defining one side of the notch and to which the upper ends of the front crossed legs are pivotally connected and a second wall at the underside, generally perpendicular to the first wall and combined therewith, to which the upper ends of the other of the side crossed legs are also pivotally connected. In like manner, each of the front and rear connector pads (as well as the rear connectors) include the two generally perpendicular walls for fastening with their respective pivotally connected legs while the rear connector pads include apertures at the join of the two walls where the side supports are fixed.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
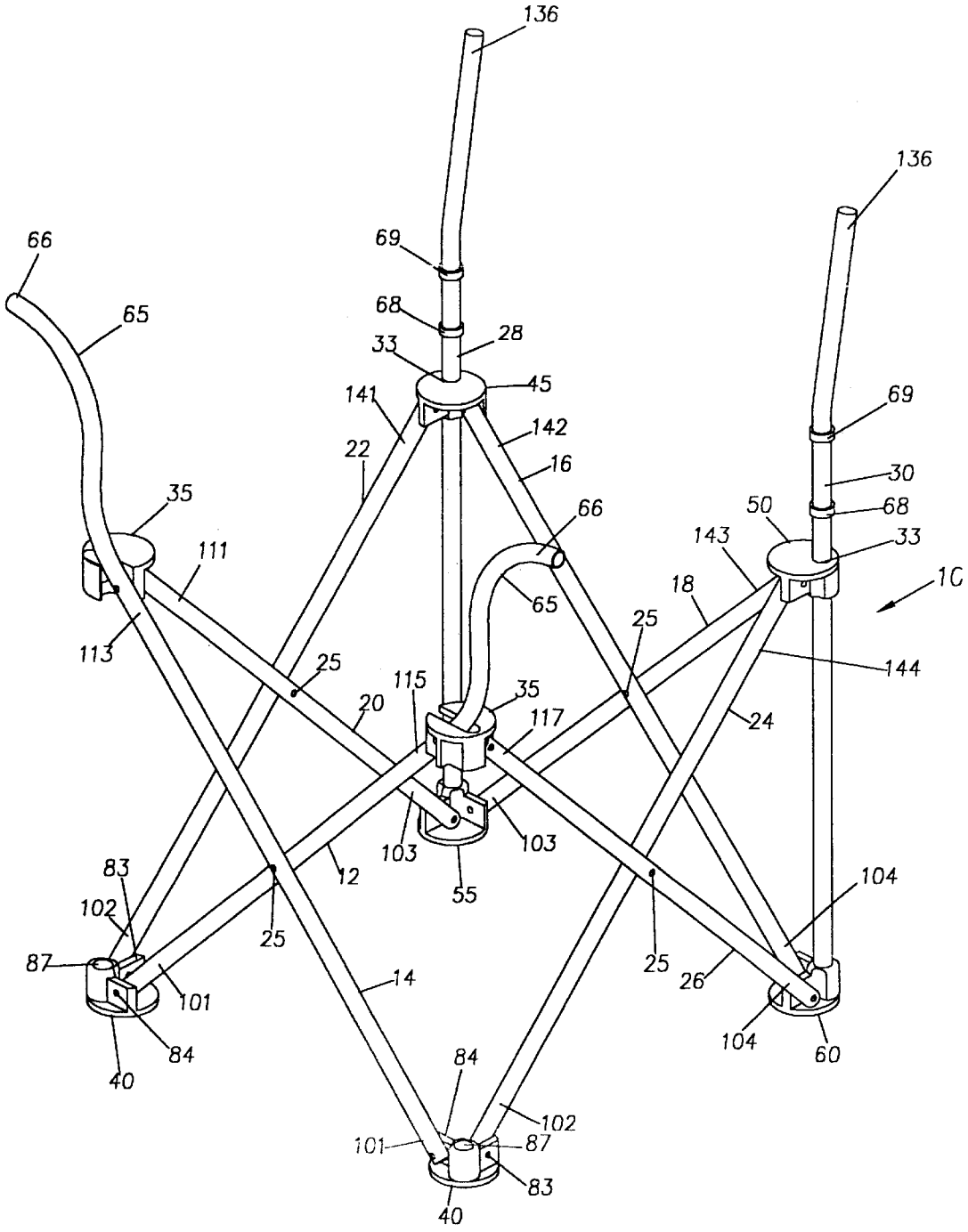
FIG. 1 is a front perspective view of the collapsible patio chair of the invention in an unfolded position, with its seating fabric removed.

As with the folding chair of U.S. Pat. No. 5,984,406, the collapsible patio chair of the present invention is constructed out of tubular members. In particular, the frame of the patio chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 20 & 22 and 24 & 26 are tubular, and are constructed of aluminum or steel.

Figure 2:
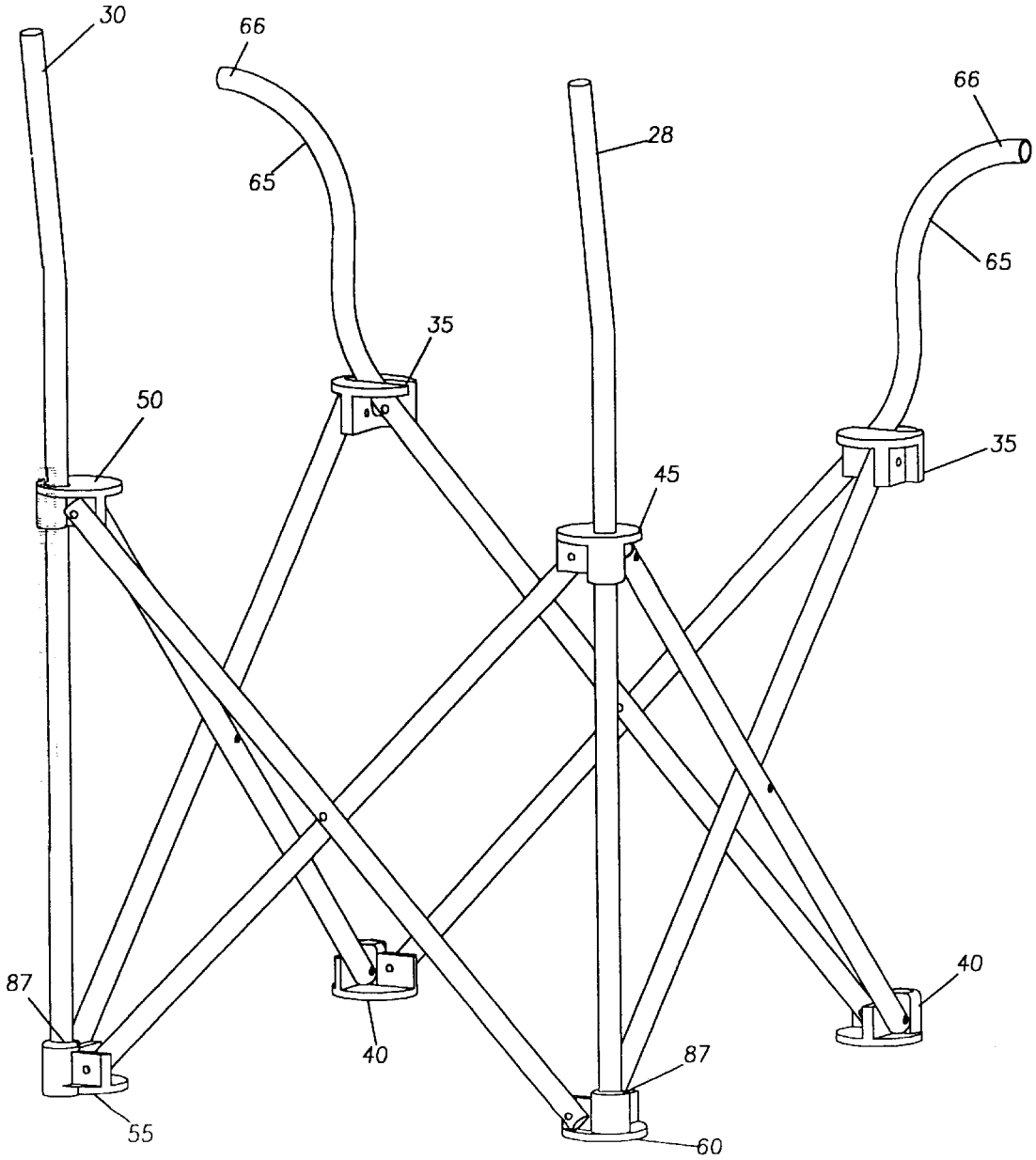
FIG. 2 is a rear perspective view of the patio chair in its unfolded position.
Figure 3:
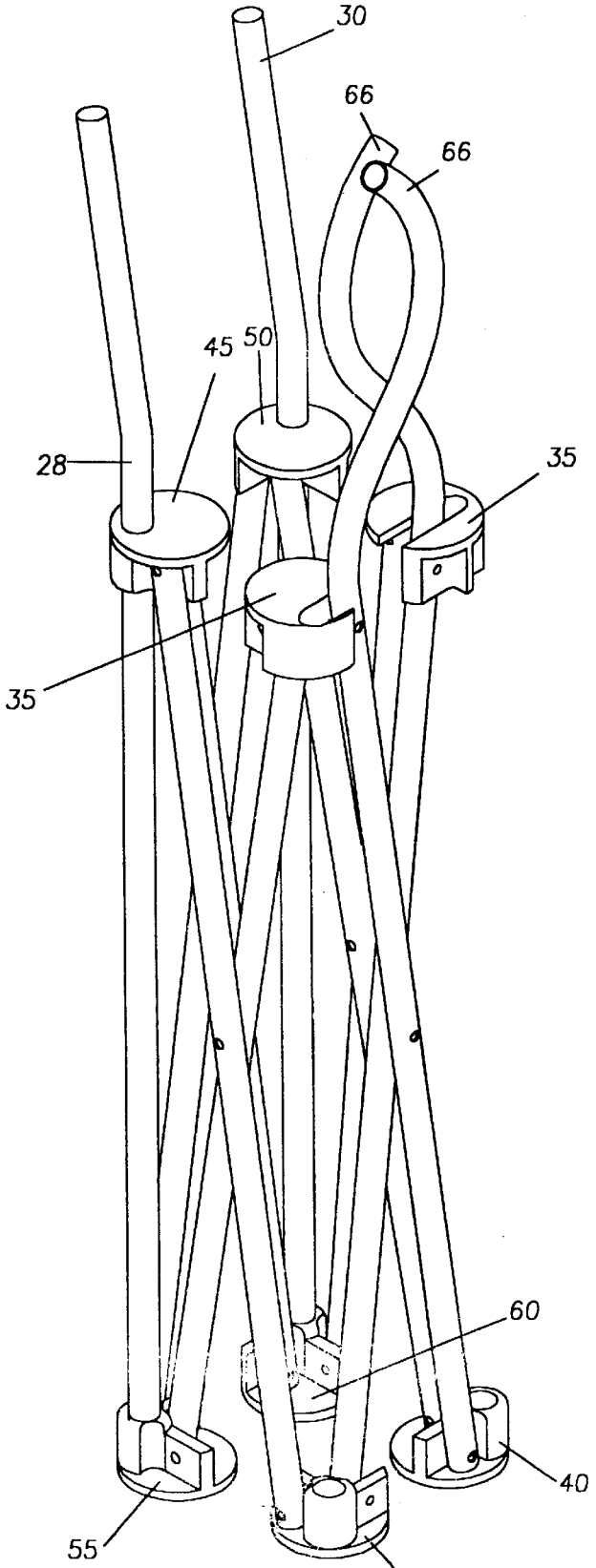
FIG. 3 is a front perspective view of the patio chair when fully collapsed, ready for storage.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–3, the side supports 28, 30 respectively extend downwardly through apertures 33, in the rear connectors 45, 50, to fix with the rear pad connectors 55 and 60 without pivoting. With the patio chair to be constructed with hand rests, each front leg 12, 14 is provided with an extension 65 that extends upwardly through the front connectors 35 and bends outwardly to form a front support 66 where it is secured, as by a screw, with a sleeve at a front underside of a fabric hand rest (15, in FIG. 4), at the rear of which a grommet 67 on the fabric encircles the side supports 28, 30, and where it is restricted in upwards movement by a ring 68 on the supports 28, 30. As with the hand rests of U.S. Pat. No. 5,984,406, the hand rest 15 provides a support for the user's arm, as well as a manner to fold and unfold the chair with adequate leverage.

Particularly referring to FIGS. 1, 2, 7A & 7B, and 8A & 8B, the lower end 101 of the crossed legs 12 & 14 are fastened by rivet or other pivot manner to the front wall 84 of the front pad connector 40 shown as having a generally perpendicular side wall 83, the fastener passing through its aperture 86A. Similarly, the lower end 102 of the crossed legs 22 & 24 is also fastened by rivet, or other pivot to the wall 83, by means of its aperture 86B. As illustrated, both front pad connectors 40 are identical, with one of the lower ends 101 being pivoted on one surface of the front wall 84, with the other one of the lower ends 101 being on the opposite surface of the front wall 84, and with the two lower ends 102 being pivoted on opposing faces of the side wall 83.

Figure 8B:
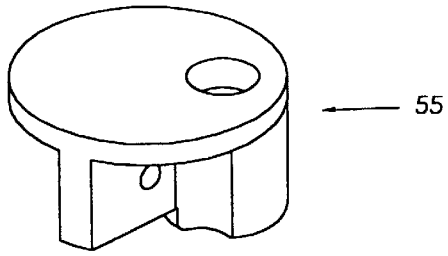
FIGS. 8A & 8B are top and bottom views respectively of the rear connectors pads.
Figure 7A:
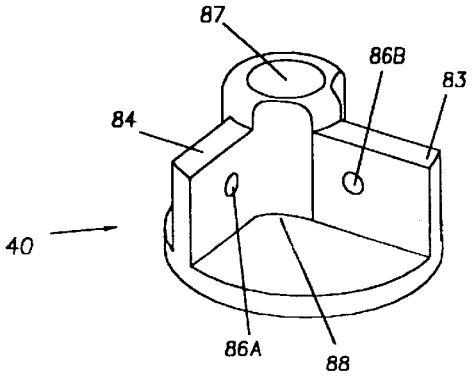
Figure 8A:
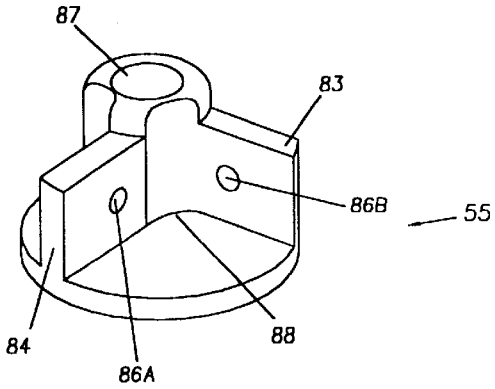
Figure 10A:
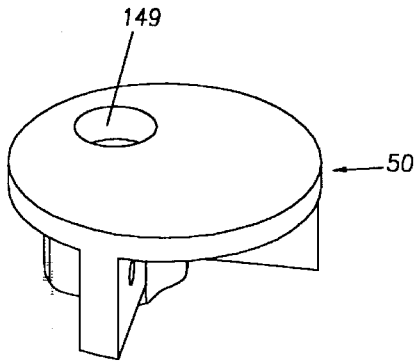
FIGS. 9A & 9B and 10A & 10B are top and bottom perspective views respectively of the rear connectors of the patio chair.
Figure 10B:
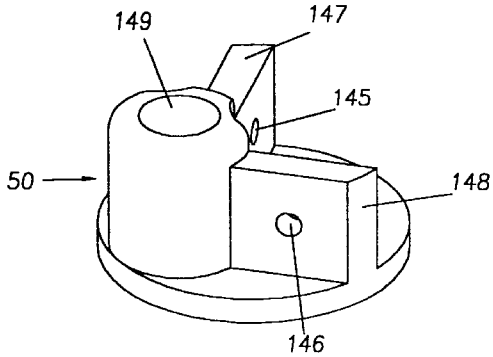
Figure 9A:
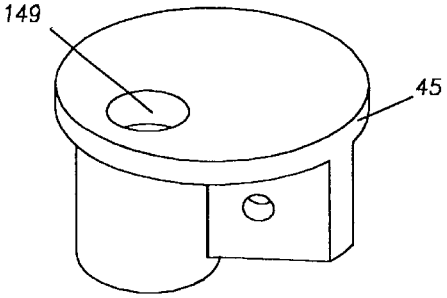
Figure 9B:
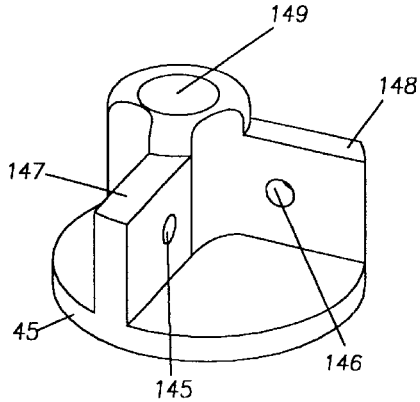

In like manner, the lower end 103 of the crossed legs 18 & 20 and the lower end 104 of the crossed legs 16 & 26 are fastened by rivets, or other pivots to the rear pad connectors 55, 60 respectively, with the rear pad connector 55 being of the configuration shown in FIGS. 8A & 8B, and with the rear pad connector 60 being of the configuration shown in FIGS. 8A & 8B rotated 90° counterclockwise. Each of the connectors 55, 60 thus include their own pairs of generally perpendicular walls and their own apertures. As indicated, the lower end 103 of leg 20 is fastened by pivot or otherwise to rear pad connector 55 at one surface of the wall 84 via aperture 86A while the lower end 103 of leg 18 is fastened by pivot or otherwise to one surface of the wall 83 via aperture 86B. Correspondingly, the lower end 104 of leg 26 is fastened to the opposing surface of wall 84 of connector 60 via aperture 86A, while the lower end 104 of leg 16 is fastened to the opposing surface of wall 83 via aperture 86B. In accordance with the invention, apertures 87 are included at the joinings 88 of the walls 83, 84 of the connectors 55, 60 to receive the lower ends of the side supports 28, 30, where they are fixed by rivets or otherwise, without pivoting. Although not receiving side supports, the front pad connectors 40 may be constructed with a similar aperture 87 at the joinings 88 of their walls 83, 84, to allow for a common construction of these front and rear pad connectors and an interchangeability of components, although such apertures 87 at the front pad connectors are not needed for operation of the collapsible patio chair.

The upper end 111 of leg 20 and the upper end 113 of leg 14 are fastened together in front connector 35 in manner identical to the fastening in connector 35 of upper end 115 of leg 12 and upper end 117 of leg 26. The connectors 35 are illustrated in FIGS. 5A & 5B and 6A & 6B—with the configurations of FIG. 5A & 5B receiving the legs 12 and 26, and with the configuration of FIGS. 6A and 6B receiving the legs 14 and 20. As shown, the connectors 35 include a top surface 90 having a notch therein 91 open at one end, understood to be slightly larger than the diameter of the crossed legs 12, 14 when composed as a tubular configuration. This dimensioning allows the legs 12, 14 to glide easily within the notch 91 as the patio chair is folded closed or opened. As more particularly shown in FIGS. 5B and 6B, the front connectors 35 further include a first wall 92 at an underside defining one side of the notch 91 and to which the legs 14 and 12 are fastened. At the same time, the connectors 35 include a second wall 93 at the underside, generally perpendicular to the wall 92 in combination therewith, to which the upper ends 111 and 117 of the crossed legs 20 and 26 are fastened. In similar manner, both perpendicular walls 92, 93 are provided with apertures 95, 96 for fastening with their respective pivotally connected legs.

The upper end 141 of the leg 22 is similarly coupled with the upper end 142 of leg 16 within the connector 45, designed as a mirror image of the connector 50 which receives the upper end 143 of leg 18 and the upper end 144 of leg 24. These connectors 45 and 50 are illustrated in FIGS. 9A & 9B and 10A & 10B respectively, with one leg fastened through each aperture 145 and 146 of the perpendicular walls 147 and 148 as shown, and with the aperture 149 corresponding to the aperture 33 in the connectors 45 and 50 of FIG. 1 through which the side supports 28, 30 pass.

Figure 4:
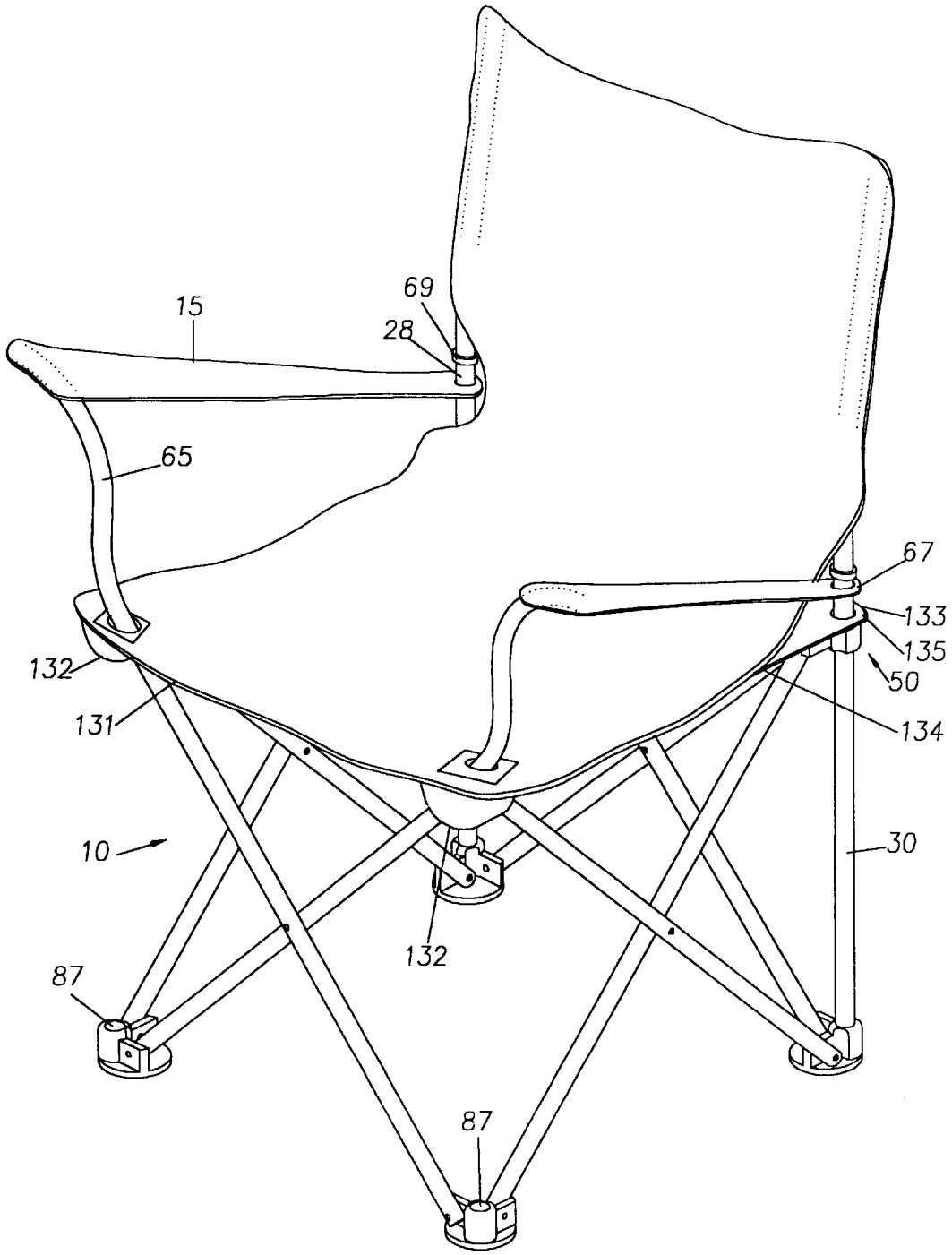
FIG. 4 is a front perspective view of the collapsible patio chair in its unfolded position, with the seating fabric in place.
Figure 5A:
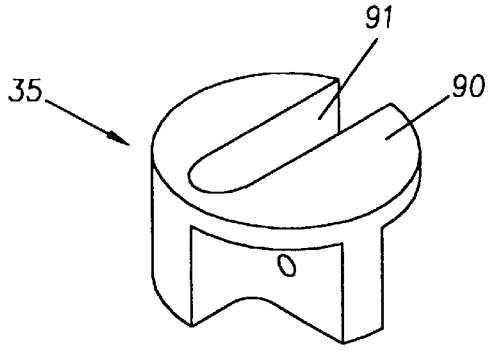
FIGS. 5A & 5B and 6A & 6B are top and bottom perspective views respectively of the front connectors of the patio chair.
Figure 5B:
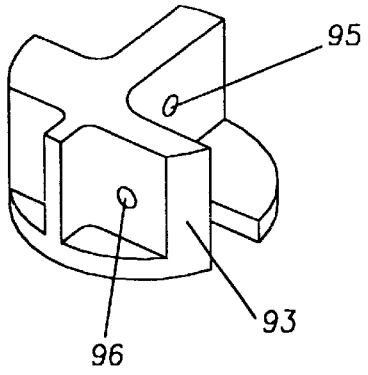
Figure 6A:
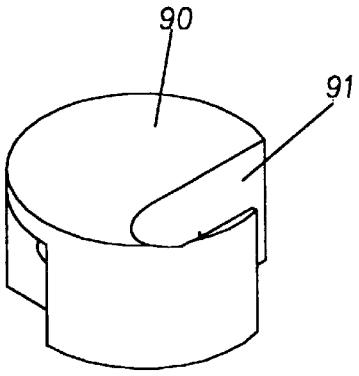
Figure 6B:
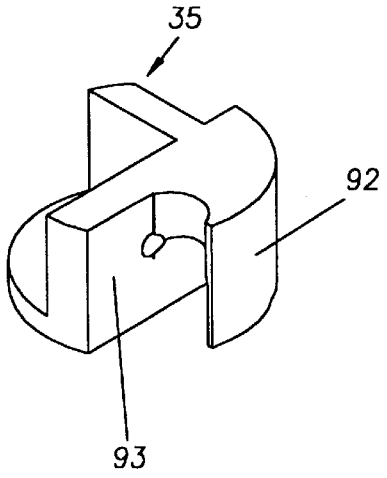
Figure 7B:
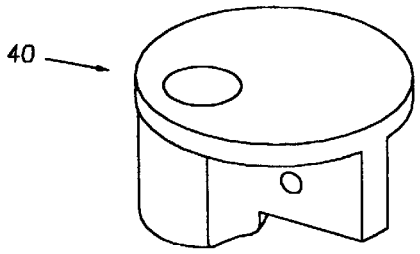
FIGS. 7A & 7B are top and bottom perspective views respectively of the front connector pads.

FIG. 4 illustrates the manner of attaching the fabric liner 131 to the chair frame 10. A sleeve at an underside of the liner front 132 is pulled down once installed at A to fit over the front connectors 35. A strap 133 is sewn at left and right undersides 134 of the fabric liner 131, and is provided with an opening defined by a grommet 135 through which the side supports 28, 30 pass. As shown, the strap 133 rests atop the rear connectors 45, 50, and its upward movement is restricted by a second ring 69 on the side supports 28, 30. Sleeves are also included at the rear underside of the fabric liner 131, adjacent its top, to slip over the top 136 of the supports 28, 30 (where they are secured as by a screw), with all areas of connection of the fabric liner being reinforced in any desired manner.

To collapse the opened chair of FIG. 1, all that is needed is for one to grasp onto the upper bends 65 of the legs 12, 14, and push them towards one another. The legs 12, 14 readily slide within the notch 91, and the pivot connections of all the legs to opposing faces of the perpendicular walls reliably collapses the frame 10 to the compact configuration of FIG. 3. Then, in a collapsed condition, the patio chair can be placed in a duffle bag and carried out, or otherwise stored. As will be appreciated, the collapsing of the chair to the configuration of FIG. 3 will be understood to fold the fabric hand rest 15 upwardly and out of the way at the same time.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A collapsible chair comprising:

a frame including pairs of front crossed legs and rear crossed legs, and two pairs of side crossed legs, with each pair of crossed legs being pivotally connected together where they cross;

first and second front pad connectors pivotally connected to lower ends of one of said front crossed legs and one of said side crossed legs, respectively;

first and second rear pad connectors pivotally connected to lower ends of one of said rear crossed legs and the other of said side crossed legs, respectively;

first and second front connectors pivotally connected to upper ends of said one front crossed leg and said other of said side crossed legs, respectively;

first and second rear connectors pivotally connected to upper ends of said rear crossed legs and said one of said side crossed legs, respectively;

a pair of side supports passing through apertures in each of said first and second rear connectors having lower ends fixedly connected to said rear pad connectors; and a fabric liner connected to said first and second front connectors and to upper ends of said pair of side supports;

with said front connectors including a top surface having a notch therein open at one end and slightly larger than a diameter of said front crossed legs when composed as a tubular configuration.

2. The collapsible chair of claim 1 wherein said front connector includes a first wall at an underside thereof defining a first side of said notch and to which said upper ends of said front crossed legs are pivotally connected, and a second wall at said underside, generally perpendicular to said first wall and combined therewith, to which said upper ends of said other of said side crossed legs are pivotally connected.

3. The collapsible chair of claim 2 wherein each of said front and rear connectors pads include a pair of generally perpendicular walls for fastening with their respective pivotally connected legs, and wherein said rear connector pads include apertures at the joinings of said perpendicular walls where said side supports are fixed, without pivoting.

4. The collapsible chair of claim 1, also including a strap on an underside of said fabric liner resting atop said first and second rear connectors.

5. The collapsible chair of claim 1 wherein each of said front and rear pad connectors include a pair of perpendicular apertured walls;

with one wall of said first and second front pad connectors being pivotally connected on opposite sides with said lower ends of said front crossed legs;

with the other wall of said first and second front pad connectors being pivotally connected on opposite sides with said lower ends of said one side crossed leg;

with one wall of said first and second rear pad connectors being pivotally connected on opposite sides with said lower ends of said rear crossed legs; and with the other wall of said first and second rear pad connectors being pivotally connected on opposite sides with said lower ends of said other side crossed legs.

6. The collapsible chair of claim 1, including a sleeve at a front underside of said fabric liner of dimension to fit about said first and second front connectors.

7. The collapsible chair of claim 1 wherein a sleeve is provided at a top underside of said fabric liner for receiving a top end of said pair of said supports.

* * * * *

US006322138C1

(12) EX PARTE REEXAMINATION CERTIFICATE (10223rd)

United States Patent

Tang

(10) Number: US 6,322,138 C1

(45) Certificate Issued: Jul. 15, 2014

(54) COLLAPSIBLE PATIO CHAIR

(76) Inventor: Larry Tang, East Brunswick, NJ (US)

Reexamination Request:
No. 90/012,886, Jun. 4, 2013

Reexamination Certificate for:

| | |
|---|---|
| Patent No.: | **6,322,138** |
| Issued: | **Nov. 27, 2001** |
| Appl. No.: | **09/561,339** |
| Filed: | **Apr. 28, 2000** |

(51) Int. Cl.

| | |
|---|---|
| ***A47C 4/48*** | (2006.01) |
| ***A47C 4/00*** | (2006.01) |
| ***A47C 4/28*** | (2006.01) |

(52) U.S. Cl.
USPC ..... 297/45; 297/16.2

(58) Field of Classification Search
None
See application file for complete search history.

(56) References Cited

To view the complete listing of prior art documents cited during the proceeding for Reexamination Control Number 90/012,886, please refer to the USPTO's public Patent Application Information Retrieval (PAIR) system under the Display References tab.

*Primary Examiner* — Peter C. English

(57) ABSTRACT

A patio chair incorporating a frame having left and right hand rests and pairs of crossed front, rear and side legs, and with connectors for stabilizing the chair when opened and for collapsing the chair to a compact package when closed, with front pad and rear pad connectors, and with rear connectors, being configured with generally perpendicular walls to apertures of which upper and lower ends of both rear legs and one side leg are pivotally connected, and with front connectors including a notch within which the upper end of both front crossed legs are arranged to glide in forming the support for the hand rests, and to which an upper end of the other side leg is also pivotally connected, for automatically folding the hand rests as the chair is being collapsed.

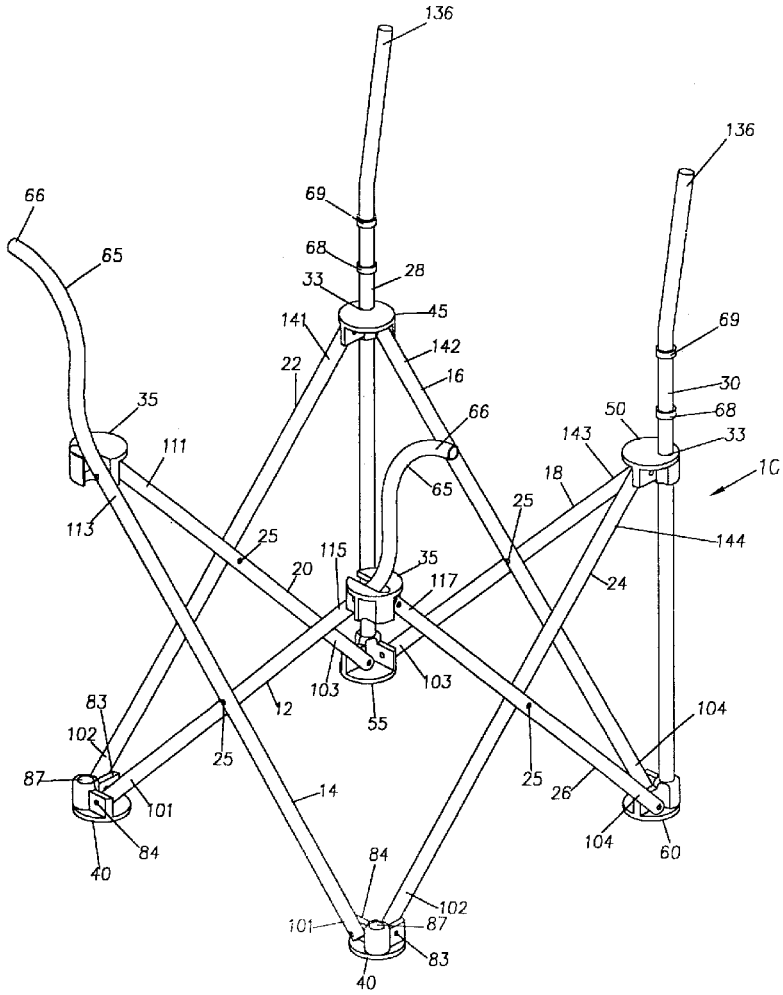

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-7 is confirmed.

New claims 8-21 are added and determined to be patentable.

*8. A collapsible patio chair comprising:*

*a frame including pairs of front crossed legs and rear crossed legs, and two pairs of side crossed legs, with each pair of crossed legs being pivotally connected together where they cross;*

*first and second front pad connectors pivotally connected to lower ends of one of said front crossed legs and one of said side crossed legs, respectively;*

*first and second rear pad connectors pivotally connected to lower ends of one of said rear crossed legs and the other of said side crossed legs, respectively;*

*first and second front connectors pivotally connected to upper ends of said one front crossed leg and said other of said side crossed legs, respectively;*

*first and second rear connectors pivotally connected to upper ends of said rear crossed legs and said one of said side crossed legs, respectively;*

*a pair of side supports passing through apertures in each of said first and second rear connectors having lower ends fixedly connected to said rear pad connectors; and*

*a fabric liner connected to said first and second front connectors and to upper ends of said pair of said supports;*

*with said front connectors including a top surface having a notch therein open at one end and slightly larger than a diameter of said front crossed legs when composed as a tubular configuration;*

*and with said front crossed legs readily slidable within each of said notches in collapsing and opening said frame.*

*9. The collapsible patio chair of claim 8 wherein said front connector includes a first wall at an underside thereof defining a first side of said notch and to which said upper ends of said front crossed legs are pivotally connected, and a second wall at said underside, generally perpendicular to said first wall and combined therewith, to which said upper ends of said other of said side crossed legs are pivotally connected.*

*10. The collapsible patio chair of claim 9 wherein each of said front and rear connectors pads include a pair of generally perpendicular walls for fastening with their respective pivotally connected legs, and wherein said rear connector pads include apertures at the joinings of said perpendicular walls where said side supports are fixed, without pivoting.*

*11. The collapsible patio chair of claim 8, also including a strap on an underside of said fabric liner resting atop said first and second rear connectors.*

*12. The collapsible patio chair of claim 8 wherein each of said front and rear pad connectors include a pair of perpendicular apertured walls;*

*with one wall of said first and second front pad connectors being pivotally connected on opposite sides with said lower ends of said front crossed legs;*

*with the other wall of said first and second front pad connectors being pivotally connected on opposite sides with said lower ends of said one side crossed leg;*

*with one wall of said first and second rear pad connectors being pivotally connected on opposite sides with said lower ends of said rear crossed legs; and*

*with the other wall of said first and second rear pad connectors being pivotally connected on opposite sides with said lower ends of said other side crossed legs.*

*13. The collapsible patio chair of claim 8, including a sleeve at a front underside of said fabric liner of dimension to fit about said first and second front connectors.*

*14. The collapsible patio chair of claim 8 wherein a sleeve is provided at a top underside of said fabric liner for receiving a top end of said pair of said supports.*

*15. A collapsible patio chair for casual seating comprising:*

*a frame including pairs of front crossed legs and rear crossed legs, and two pairs of said crossed legs, with each pair of crossed legs being pivotally connected together where they cross;*

*first and second front pad connectors pivotally connected to lower ends of one of said front crossed legs and one of said side crossed legs, respectively;*

*first and second rear pad connectors pivotally connected to lower ends of one of said rear crossed legs and the other of said side crossed legs, respectively;*

*first and second front connectors pivotally connected to upper ends of said one front crossed leg and said other of said side crossed legs, respectively;*

*first and second rear connectors pivotally connected to upper ends of said rear crossed legs and said one of said side crossed legs, respectively;*

*a pair of side supports passing through apertures in each of said first and second rear connectors having lower ends fixedly connected to said rear pad connectors; and*

*a fabric liner connected to said first and second front connectors and to upper ends of said pair of side supports;*

*first and second fabric hand rests respectively connected between front supports on said first and second front crossed legs and one of said pair of side supports;*

*with said front connectors including a top surface having a notch therein open at one end and slightly larger than a diameter of said front crossed legs when composed as a tubular configuration;*

*with said front crossed legs readily slidable within each of said notches in collapsing and opening said frame;*

*and with said front crossed legs readily slidable within each of said notches in folding said fabric hand rests upwardly upon a collapsing of said frame and downwardly upon an opening of said frame.*

*16. The collapsible patio chair of claim 15 wherein said front connector includes a first wall at an underside thereof defining a first side of said notch and to which said upper ends of said front crossed legs are pivotally connected, and a second wall at said underside, generally perpendicular to said first wall and combined therewith, to which said upper ends of said other of said side crossed legs are pivotally connected.*

*17. The collapsible patio chair of claim 16 wherein each of said front and rear connectors pads include a pair of generally perpendicular walls for fastening with their respective pivotally connected legs, and wherein said rear connector pads include apertures at the joinings of said perpendicular walls where said side supports are fixed, without pivoting.*

*18. The collapsible patio chair of claim 15, also including a strap on an underside of said fabric liner resting atop said first and second rear connectors.*

*19. The collapsible patio chair of claim 15 wherein each of said front and rear pad connectors include a pair of perpendicular apertured walls*

*with one wall of said first and second front pad connectors being pivotally connected on opposite sides with said lower ends of said front crossed legs;*

*with the other wall of said first and second front pad connectors being pivotally connected on opposite sides with said lower ends of said one side crossed leg;*

*with one wall of said first and second rear pad connectors being pivotally connected on opposite sides with said lower ends of said rear crossed legs; and*

*with the other wall of said first and second rear pad connectors being pivotally connected on opposite sides with said lower ends of said other side crossed legs.*

*20. The collapsible patio chair of claim 15, including a sleeve at a front underside of said fabric liner of dimension to fit about said first and second front connectors.*

*21. The collapsible patio chair of claim 15 wherein a sleeve is provided at a top underside of said fabric liner for receiving a top end of said pair of said supports.*

* * * * *